US009422663B1

(12) United States Patent
Roa-Espinosa

(10) Patent No.: US 9,422,663 B1
(45) Date of Patent: Aug. 23, 2016

(54) APPARATUS AND PROCESS FOR TREATMENT OF BIOCOMPONENTS

(71) Applicant: Aicardo Roa-Espinosa, Madison, WI (US)

(72) Inventor: Aicardo Roa-Espinosa, Madison, WI (US)

( * ) Notice: Subject to any disclaimer, the term of this patent is extended or adjusted under 35 U.S.C. 154(b) by 0 days.

(21) Appl. No.: 14/934,115

(22) Filed: Nov. 5, 2015

(51) Int. Cl.
*D21C 9/00* (2006.01)
*D21C 1/00* (2006.01)

(52) U.S. Cl.
CPC *D21C 9/001* (2013.01); *D21C 1/00* (2013.01); *D21C 9/004* (2013.01); *D21C 9/007* (2013.01)

(58) Field of Classification Search
CPC ..... D21C 1/02; D21C 9/001; D21C 9/004
See application file for complete search history.

(56) References Cited

U.S. PATENT DOCUMENTS

| | | | | |
|---|---|---|---|---|
| 4,644,060 | A | 2/1987 | Chou | |
| 5,171,592 | A | 12/1992 | Holtzapple et al. | |
| 5,473,061 | A | 12/1995 | Bredereck et al. | |
| 5,641,385 | A | 6/1997 | Croft et al. | |
| 6,158,167 | A | 12/2000 | Spittle | |
| 6,176,176 | B1 | 1/2001 | Dale et al. | |
| 6,349,499 | B1 | 2/2002 | Spittle | |
| 6,360,478 | B1 | 3/2002 | Spittle | |
| 8,231,764 | B2 * | 7/2012 | Husband | D21B 1/30 162/181.1 |
| 8,444,810 | B2 | 5/2013 | Roa-Espinosa | |
| 2003/0172464 | A1 | 9/2003 | Hu et al. | |
| 2006/0070294 | A1 | 4/2006 | Spittle | |
| 2007/0029252 | A1 | 2/2007 | Dunson, Jr. et al. | |
| 2007/0031953 | A1 | 2/2007 | Dunson, Jr. et al. | |
| 2008/0008783 | A1 | 1/2008 | Dale | |
| 2012/0180962 | A1 * | 7/2012 | Roa-Espinosa | D21C 1/02 162/60 |

OTHER PUBLICATIONS

Jankovic A., Variables affecting the fine grinding of minerals using stirred mills, 2003, Mechnical Engineering, 16, p. 337-345.*

* cited by examiner

*Primary Examiner* — Anthony Calandra
(74) *Attorney, Agent, or Firm* — Steven H. Greenfield; Greenfield Invention and Patent Consulting, Inc.

(57) ABSTRACT

A process for treatment of biomass materials is disclosed. The treatment comprises of applying mechanical rubbing and crushing action to the biomass materials that result in significant reduction in the biomass particle size. The treatment is carried out in a chamber where the biomass is subjected to the action of a plurality of rotating pins against channels disposed on the chamber interior wall. The maceration of the biomass is further aided by impact from a plurality of blocks and sand particles placed inside the treatment chamber that are hurled into motion inside the chamber through collision with the rotating pins. Chemical catalysts may be used to speed up the maceration. These include aluminum silicate, either an acid or alkaline pretreatment, gaseous urea or urea granules. The treatment produces materials that are beneficial in a variety of applications such as soil erosion prevention, biofuel manufacturing, plant growth substrates and animal bedding.

11 Claims, 7 Drawing Sheets

APPARATUS AND PROCESS FOR TREATMENT OF BIOCOMPONENTS

FIELD OF THE INVENTION

The present invention relates to a process and apparatus for treating a variety of fibrous and granular biomaterials to liberate biocomponents such as celluloses, hemicelluloses, sugars and lignin to make them accessible for removal, chemical reactions and utilization in products such as fertilizers, soil erosion additives and animal feed. More specifically, the present invention relates to a process and apparatus for treating substantially low moisture raw biomass materials in fibrous, fiber bundle and granular form. The treatment provides a number of benefits including improved water holding capacity and reduced crystallinity that are beneficial in a variety of applications, such as biofuel manufacturing and soil erosion prevention as well as in products such as plant growth substrates and animal bedding.

BACKGROUND OF THE INVENTION

Biomass materials contain valuable materials that may be used in a variety of applications such as the production of fuels, feeds and chemicals. The release, segregation and collection of these useful materials are accomplished in the art using a variety of chemical, mechanical and enzymatic processes. Of primary benefit is the release of fermentable sugars such as hexose and pentose that can then be used in the production of biofuels such as ethanol. For these processes to be effective, it is desirable to modify the biomass mechanically and chemically.

Prior art references disclose methods for treating fibers with ammonia. U.S. Pat. No. 4,644,060 discloses a method for increasing the bioavailability of polysaccharide components of ligno-cellulosic materials by treatment with ammonia in a supercritical or near-supercritical fluid state at temperatures ranging from 100 degrees C. to 200 degrees C. and pressures ranging from 6.9 MPa to 35 MPa. Another treatment agent is ethylenediamine that is disclosed as an aid in the removal of lignin in U.S. Pat. No. 5,641,385. U.S. Pat. Nos. 5,171,592 and 5,473,061 and US Pre-Grant Publication number 20080008783 describe methods for exploding biomass by rapidly reducing the pressure at which the biomass is treated, thereby exposing the value components in biomass to swelling agents such as ammonia and amines. These processes require high pressure vessels and are difficult and cumbersome to run cost effectively. Also, these processes tend to destroy some the valuable materials in the fibers such as lignin and hemicelluloses. U.S. Pat. No. 8,444,810 discloses a fiber treatment process in which a mixture of steam, gaseous ammonia and gaseous amine that may contain urea and ethylenediamine is fed through one or more feed ports in the chamber. In one embodiment of U.S. Pat. No. 8,444,810, superheated steam at a temperature in the range of about 140-180° C. and a pressure of about 2 Kilopascals gauge. The steam softens the fiber bundles, which facilitates the macerating action of the pins to separate the fibers while reducing the likelihood of fiber length reduction. While U.S. Pat. No. 8,444,810 presents a substantial simplification relative to the prior art, the high temperature, pressure and the use of chemicals in the treatment vessel are nevertheless a negative aspect that is undesirable.

SUMMARY OF THE PRESENT INVENTION

The process of the present invention comprises a process of treating fibers and proteins by continually exposing the surfaces of biomass materials in fiber and granular form to mechanical maceration and chemical treatment agents while liberating out components such as lignin and hemicelluloses from the fibers that have value in other applications such as soil erosion control and as components in high molecular weight biofuels. The valuable cellulose fibers may be contained in fiber bundles that are byproducts of harvest or sawmill processes of wood or from processes to recover such fibers from waste materials such as manure and food waste biomass. Separating the fiber bundles is an important step in order to make the fibers accessible to the treatment agents. This is accomplished in the present invention by applying mechanical maceration action to the fibers in such a manner as to expose the fibers to the effect of treatment agents intermixed with the biomass particles as well as chemicals in the gas phase. The lignin acts as glue in the cellulose fiber matrix and therefore reduces the accessibility of reactants that may be used to impart beneficial physical characteristics to the cellulose fibers or to extract valuable chemicals from cellulose and biomass fibers. Sources for biomass materials that may be present in the feed include but not limited to: cotton, mulch, switch grass, burr plants, wheat, sorghum, hey, Sudan grass, paper waste, municipal sewer solids, manure solids, sugar cane, cassava, corn and wheat and other cereals straw, as well as protein and oil. The combination of these process steps may be carried out simultaneously at a relatively low pressure of between about 0.0 Kilopascal gauge and 2.0 Kilopascal gauge and a temperature of between 40° C. and about 60° C.

Maceration of fibers and proteins in the context of the present invention refers to applying mechanical action to protein particles, fibers and fiber bundles such as grinding or refining while the fibers are exposed to any or all of the following: liquids, vapors, heat and chemicals. Defiberizing refers to mechanical action applied to fiber bundles with the purpose of breaking up large bundles into smaller bundles as well as individual fibers, typically under ambient or close to ambient conditions and without chemical aids. Defiberizing generally results in reducing the fiber length. Proteins originating from cold press oil extraction may be used in the process of the present invention; however proteins from other sources may be used as well.

It is the object of the present invention to provide a process for transforming biomass into materials useable in the production of biofuels. It is also the object of the present invention to provide processes for transforming biomass into materials useable in soil erosion applications and into materials useable as animal feed, animal bedding, and fertilizers. It is further the object of the present invention to produce pure lignin as a byproduct of the maceration reaction. It is yet another object of the present invention to provide materials with a reduced degree of crystallinity that makes the sugar components of the fibers accessible to enzymatic treatment.

In one aspect of the present invention, a process for treating biomass materials comprises: providing protein particles, biomass materials in fiber or granular particulate form having a moisture level in the range of between about 2 percent and about 10 percent; providing a treatment apparatus comprising a treatment chamber having a feed zone and an exit zone, said treatment chamber being adapted for pressurization, said treatment chamber containing: a longitudinal central axis, a cylindrical enclosure, an interior portion having an interior surface and an exterior portion, said feed zone being adapted for communication with a biomass feeding device, said chamber being adapted for utilization under pressure; a shaft disposed along the longitudinal central axis of said chamber, said shaft being adopted for rotation around said axis; a plurality of pins affixed to said central axis, said pins protruding from the central axis, said pins being substantially perpendicular in relation to the central axis, said central axis and pins being adapted for rotation inside the chamber; a plurality of channels disposed in an inner wall surface of the cylindrical enclosure having a predetermined width, a predetermined depth and a predetermined clearance from the pins; and a plurality of blocks adapted for movement inside the treatment chamber, said movement of said blocks being actuated by collision with the pins; feeding the biomass materials into the feed zone of a treatment apparatus and moving said biomass materials from the feed zone toward the exit zone; macerating the biomass materials; and collecting the biomass at the exit zone of said treatment apparatus.

These and other features, aspects and advantages of the present invention will become better understood with reference to the following drawings, description and claims.

DETAILED DESCRIPTION OF THE INVENTION

Figure 1:
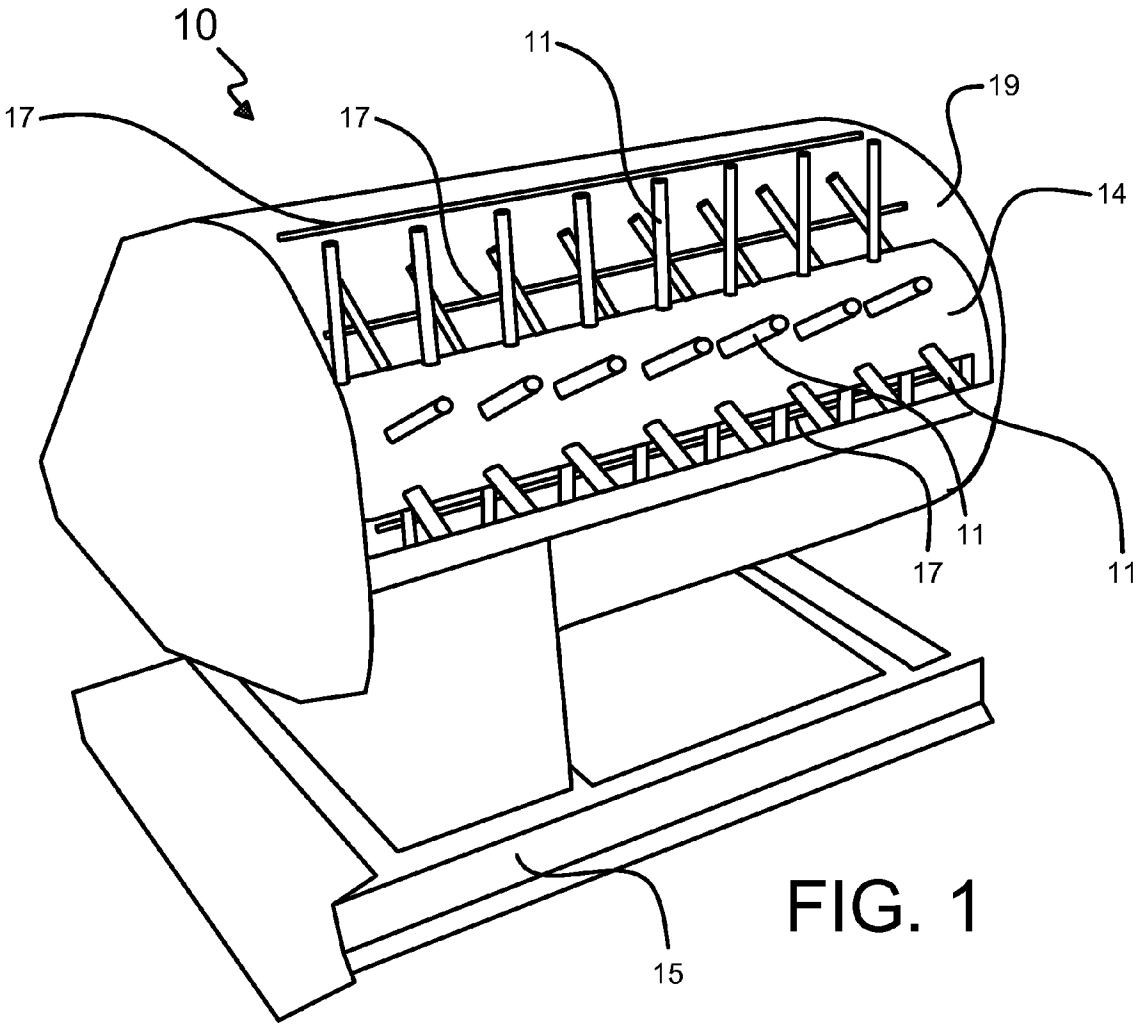
FIG. 1 is a front side cross sectional view of an apparatus for treating biomass materials according to an embodiment of the present invention.

The following detailed description is of the best currently contemplated modes of carrying out exemplary embodiments of the invention. The description is not to be taken in a limiting sense, but is made merely for the purpose of illustrating the general principles of the invention.

The present invention relates to a process for macerating biomass materials that are useful in a variety of applications. The biomass materials may contain fibrous particles, proteins, starch, sugars, and oils.

The sources of the fibrous materials may originate from brush, trees and plants that undergo processes which create residuals. Frequently, these residuals come in the form of fiber bundles that, at present, are mostly disposed of as waste. The sources include, wood chips and saw dust that originate from saw mill residuals, mulch and biomass residuals from processing cotton, animal manure fibers, switch grass, burr plants, wheat, barley, oats, rye, triticale, sorghum, hey and Sudan grass the fiber bundles contain cellulosic components that may be useful as additives in animal feed and potting soil, soil erosion prevention and production of biofuels. However, the fibers must first be released from the bundles and rendered in a form amenable to further treatments and transformations. The particulate matter containing proteins, sugars, oils and starches may originate from separation processes of raw and digested manure, brown grease, and food waste. Other sources of protein include, cotton, canola, sunflower, soybean, corn, palm oil, feathers, animal blood, and corn wholes tillage. Proteins and amino acids contain components that are useful as additives in animal feed and production of plastics. However, the proteins must first release the amino acids and render them in a form amenable to further treatments and transformations.

The process of the present invention accomplishes the release of the useful components in the materials by subjecting them to mechanical rubbing and crushing aided by the presence of blocks and sand. These materials significantly reduce the size of the feed particles. In the process of maceration, the hemicelluloses and celluloses present in the fiber components of the biomass feed are converted into sugars while the proteins are converted into amino acids. Typically, about 50% of the sugars resulting from the maceration process are monosaccharides such as glucose, about 20% are disaccharides such as sucrose, while about 30% is other types of sugars such as oligosaccharides.

A key benefit of the maceration process is that it liberates pure lignin from the fiber component of the biomass while converting the celluloses and hemicelluloses to sugars. Lignin has many uses including as a binder, a dispersant and emulsifier. It is noted that additional process steps are needed to separate out the lignin from the sugars; however, these steps are outside the scope of the present invention.

In an embodiment of the present invention, the source biomass material contains a moisture level of between about 2% and 10%. If the source material contains water >10%, the source material may be dried prior to the maceration treatment.

The treatment apparatus constitutes a modified pin mixer having a configuration such as that shown in U.S. Pat. Nos. 4,334,788 and 8,444,810. The apparatus comprises a long cylindrical chamber configured to operate under pressure. A plurality of pins is disposed on and attached to a central shaft configured longitudinally along the chamber and adapted to rotate radially. The pins may be disposed perpendicularly in relation to the shaft and may be arranged in a plurality of rows offset radially from one to another. The chamber comprises inner cylindrical walls that are modified to contain a plurality of channels disposed longitudinally along the inner surface of the chamber. The channels may range from about 0.2 inches to about 0.5 inches in width and from about 0.2 inches to about 0.5 inches in depth, and their clearance from the unattached end of the pins may range from about 0.1 inches to about 0.15 inches. Biomass materials are fed through a feed opening most typically using a screw feeder. As the biomass feed moves through the chamber and toward the exit opening, any material in bundle form accumulates inside the channels and separate into smaller bundles from the macerating, rubbing and crushing action of the pins as the shaft rotates; all the while the macerated biomass continue a forward movement from the feed opening to the exit opening. The treatment apparatus may operate continuously or in a batch mode and vary in length from about 5 feet to over 20 feet.

The treatment chamber also comprises a plurality of blocks having a dimension of between about 0.2" to about 0.5" weighing between about 1.0 to 2.0 grams. The blocks may be made of metal such as steel or aluminum; however, other materials such as wood and plastic also fall within the scope of the present invention. The blocks may have a spherical shape having a diameter of between about 0.2" to about 0.5"; however, other shapes also fall within the scope of the present invention. The ratio of the blocks and biomass material in the treatment chamber ranges from about 0.5 to about 4 blocks per gram of material. As the pins rotate, they collide with the blocks causing them to be hurled and twirl inside the treatment chamber. The blocks collide with the biomass particulate matter which further contributes to the maceration action of the materials. Sand particles containing zirconium dioxide ($ZrO_2$), calcium magnesium carbonate ($CaMg(CO_3)_2$) and silica may also be used as maceration aids. These particles have diameters in the range of about 0.0625 mm to about 2.0 mm and are used at an application rate of between about 0.25 grams to about 0.75 grams per gram of dry biomass feed. The abrasiveness of these particles contributes to the mechanical rubbing and crushing that further fragments the biomass particles and reduce the size for further treatment. A typical macerated biomass particle distribution is:

| Size in μm | Percent |
|---|---|
| 27-100 | 2 |
| 100-250 | 68 |
| 250-500 | 18 |
| <710 | 12 |

The mechanical treatment variables have a major effect on the continuous treatment process of the proteins and fibers. Specifically, it was found experimentally that the best results were achieved for pin rotation speeds in a range from about 200 to about 2000 rpm. For the purposes of the present invention, the pins may be arranged in six to eight rows around the shaft, with each row having 2-5 pins per foot of shaft length.

It is important that the biomass fed into the treatment apparatus have low moisture. Ideally, the biomass feed is dried to a moisture range in between about 2 percent and about 10 percent. A de-fiberizing step may be required prior to treatment if the biomass contains bundles are larger than about 1 inch or the fibers are longer than about 1 inch. Defiberizing may be accomplished by methods known in the art such as grinding, hammer-milling and refining.

The maceration process is aided by the addition of chemical catalysts that can speed up the maceration reaction considerably compared to mechanical action alone. The chemical treatments that may be used to catalyze the maceration action include: an alkaline pretreatment, an acid pretreatment, intermixing of aluminum silicate with the biomass feed and urea in dry form intermixed with the biomass feed and/or urea gas introduced into the treatment chamber.

It is believed that the catalysis mechanism of the aluminum silicate is related to proton-electron exchange that takes place between the electron rich biomass and the proton rich aluminum silicate.

In an embodiment of the present invention, the biomass material feed is pretreated with an alkaline solution, such as calcium oxide, sodium hydroxide or potassium hydroxide applied in a substantially dry form. Biomass materials are fed through a feed opening of the treatment apparatus most typically using a screw feeder. The apparatus contains the macerating aids in the form of blocks and sand. As the proteins or fibers move through the chamber and toward the exit opening, the radial spinning of the pins produces macerated protein and fiber fragments and particles that accumulate at the bottom of the treatment chamber and eventually exit the chamber. The macerating action reduces the size of the protein particles and the length of the fibers and also opens the fiber walls.

The biomass feed may be pretreated with a fine atomizing spray of an alkaline solution such as sodium hydroxide and/or potassium hydroxide. The concentration of the alkali is preferably in the range of about 1%-4% percent and the application rate of the alkali is in the range of about 0.01% to about 0.3% by weight of the oven dry biomass. The alkaline treatment may be done by mixing or spraying the alkali onto the biomass feed prior to the maceration treatment and is done such that the moisture content of the biomass feed material is maintained through drying in a range of about 2% to about 10%.

In another embodiment of the present invention, a strong acid such as sulfuric acid, nitric acid, hydrochloric acid may be used as an alternative to the alkaline treatment. The preferred concentration of the acid is about 1% percent and the application rate is in the range of about 0.0001% to about 0.1% by weight of the oven dry biomass. Phosphoric acid may also be used in lieu of the sulfuric acid or nitric acid. The acid is applied in a fine atomizing spray on the biomass feed then dried as necessary to a percent moisture of between about 2% to about 10%. The effect of both the alkaline pretreatment and acid pretreatment is to enhance the speed of the maceration action.

The aluminum silicate intermixed with the biomass may be kaolin or clay having an average particle size of about 0.3 microns. The ratio of the aluminum silicate to biomass in the treatment chamber may range from about 0.25 to about 1.0.

Heated air along with gaseous urea is introduced such that a pressure of between 0.0 and 2.0 KPa is maintained at a temperature of between 40° C. and about 60° C. Alternatively dry urea in a granular form is mixed with the aluminum silicate at a ratio of between about 1% to about 2% by weight to dry biomass. The urea may have a moisture not exceeding 5%. A manifold having multiple ports may be used to introduce the gas into the chamber.

Depending on the application, it may be desirable to separate the chemicals, and specifically the aluminum silicate, from the treated biomass after it exits the treatment chamber. This may be done in a Dissolved Air Flotation device (DAF).

Figure 2:
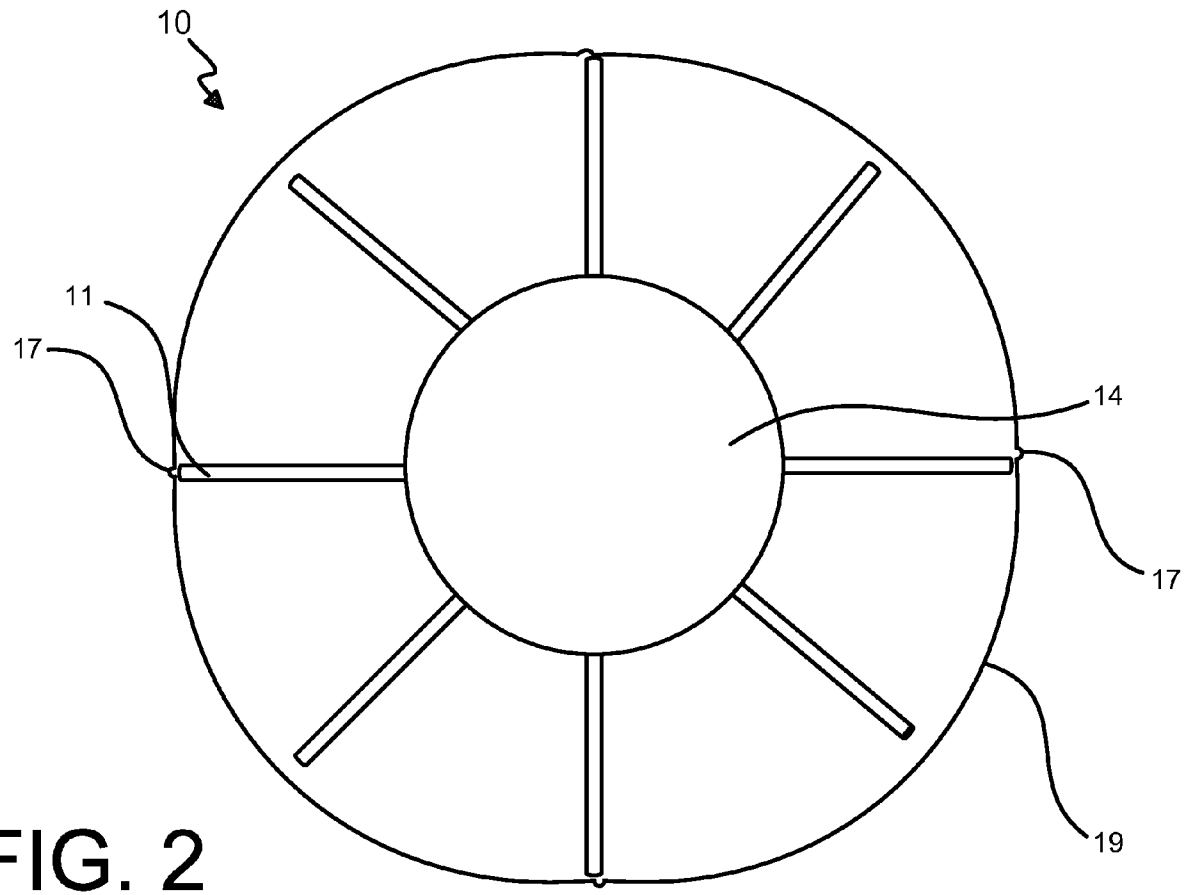
FIG. 2 is a side cross sectional view of the apparatus for treating biomass materials according to an embodiment of the present invention.
Figure 4:
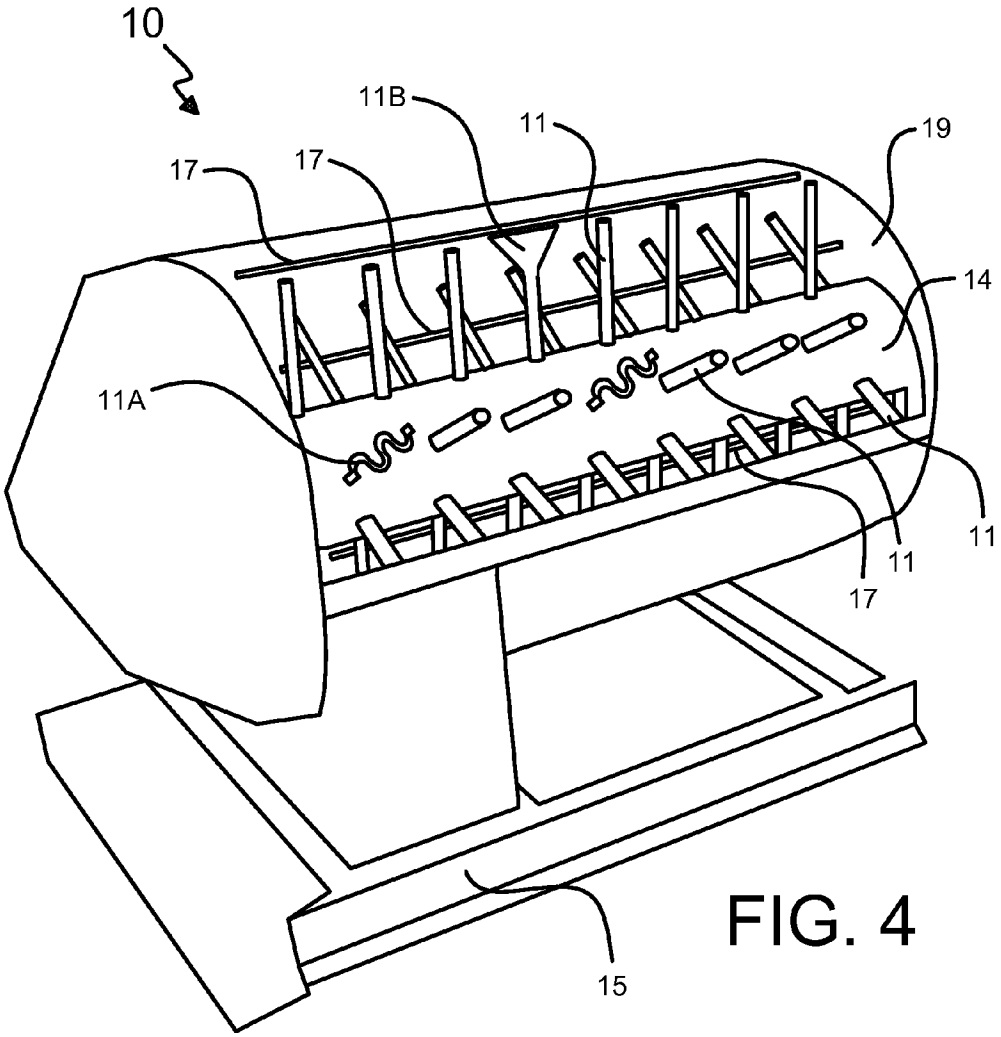
FIG. 4 is a front side cross sectional view of an apparatus for treating biomass materials according to another embodiment of the present invention.

FIGS. 1 and 2 illustrate the apparatus 10 for treating biomass showing the pins 11, the shaft 14 adapted for radial rotation, chamber walls 19, channels 17 and a base 15. In an embodiment of the present invention the pins 11 have a straight shape. In an alternate embodiment, at least some of the pins have a helical shape 11A as shown in FIG. 4. The helical shape of the pins 11A helps move the biomass from the feed zone to the exit zone. In yet another alternate embodiment, the pins may also have a triangular shaped extension at the unattached top end 11B as shown in FIG. 4. This extension also helps move the biomass from the feed zone to the exit zone.

Figure 3:
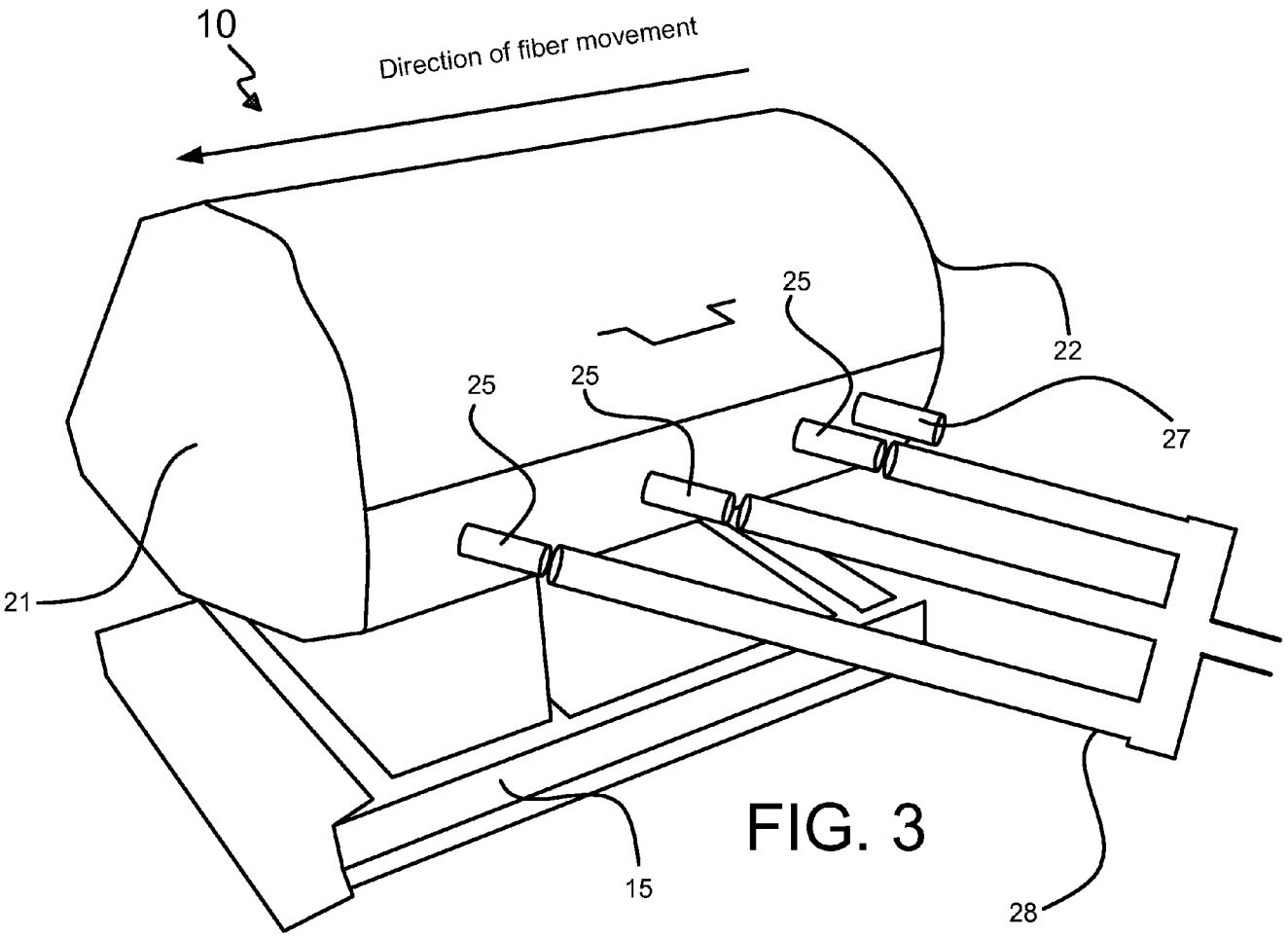
FIG. 3 is a front side view of an apparatus for treating biomass materials according to an embodiment of the present invention showing chemical treatment feed points.

The apparatus illustrated in FIG. 1 represents a batch system equipped with a raw material feed (not shown) configured to feed under pressure if necessary. FIG. 3 shows the batch apparatus in a closed position with a feed zone at 22 and an exit zone at 21. In the preferred embodiment of the present invention, the feed port 27 for the pretreatment spray is disposed in the feed zone 22 of the apparatus and at least three feed ports 25 for the urea follow the feed port and are disposed throughout the length of the treatment chamber up to the exit zone 21. The feed ports may be supplied through a manifold 28 as shown in FIG. 3.

Figure 5:
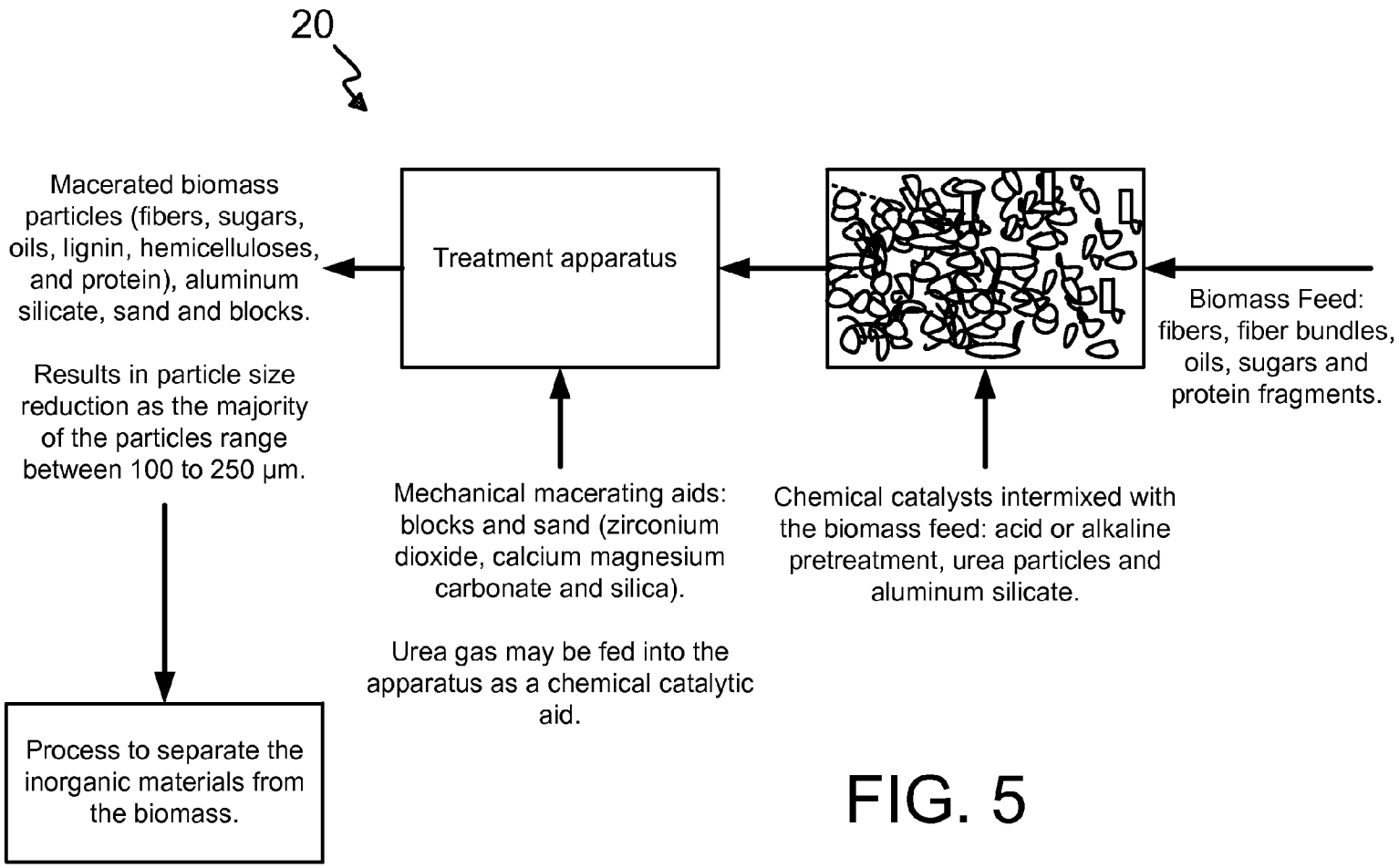
FIG. 5 is a flow schematic of the process for treating biomass materials according to an embodiment of the present invention.
Figure 6:
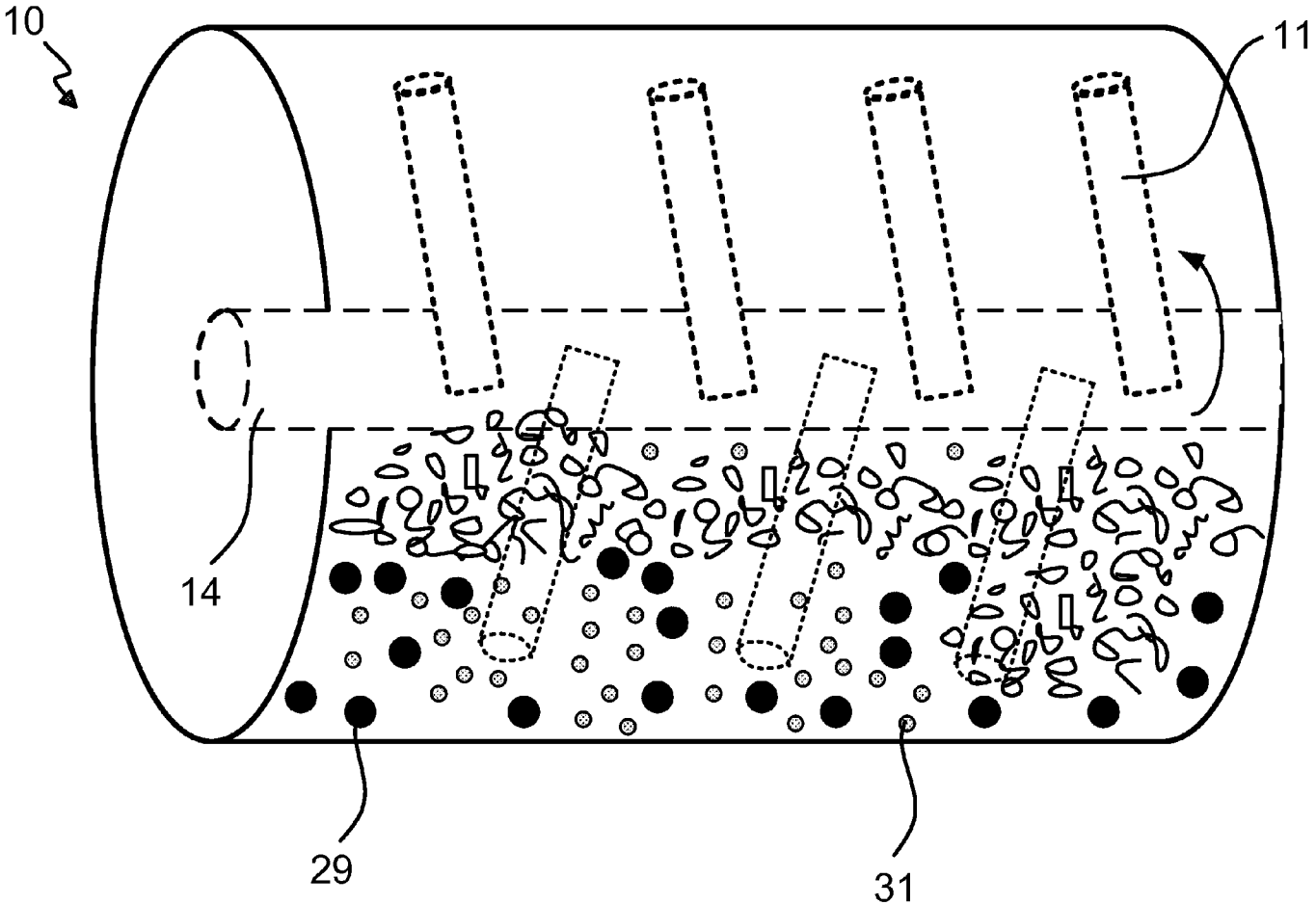
FIGS. 6 and 7 are representations of the mechanism of the treatment as carried out in the apparatus for treating biomass materials according to an embodiment of the present invention.
Figure 7:
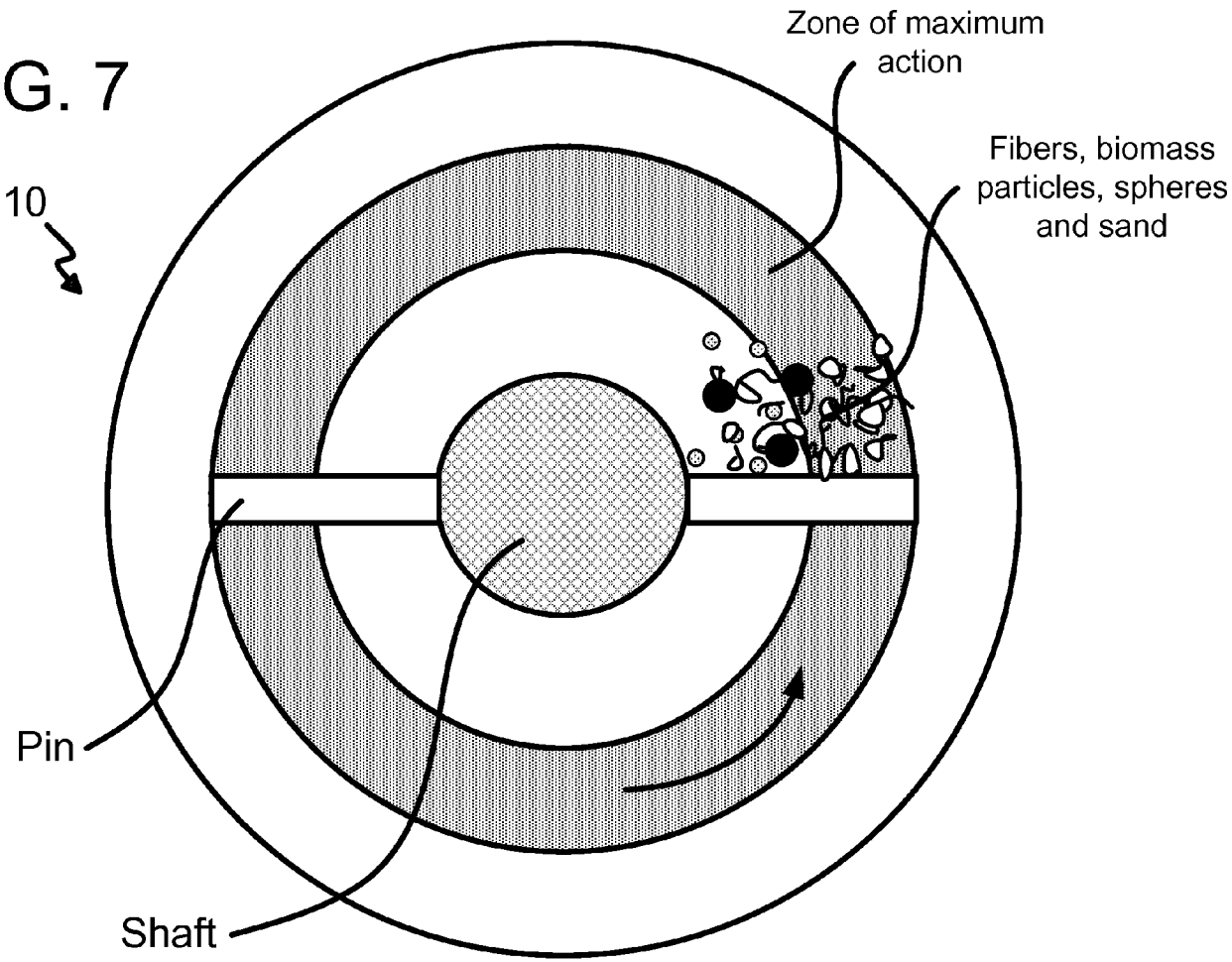

FIG. 5 is a schematic of the process 20 showing the chemical and mechanical treatments carried out in the treatment chamber on the biomass feed that result in the macerated biomass. FIGS. 6 and 7 illustrate the maceration mechanism using the combined effects of the pins (11), spheres (29) and sand (31). FIG. 7 illustrates that the zone of maximum maceration action takes place at the forward end of the pins.

It should be understood, of course, that the foregoing relates to exemplary embodiments of the invention and that modifications may be made without departing from the spirit and scope of the invention.

I claim:

1. A process for treating biomass materials comprising:

providing biomass materials in fiber or granular particulate form having a moisture level in the range of between about 2 percent and about 10 percent;

providing a treatment apparatus comprising:

a treatment chamber having a feed zone and an exit zone, said treatment chamber being adapted for pressurization, said treatment chamber containing: a longitudinal central axis, a cylindrical enclosure, an interior portion having an interior surface and an exterior portion, said feed zone being adapted for communication with a biomass feeding device, said chamber being adapted for utilization under pressure;

a shaft disposed along the longitudinal central axis of said chamber, said shaft being adapted for rotation around said axis; a plurality of pins affixed to said central axis, said pins protruding from the central axis, said pins being substantially perpendicular in relation to the central axis, said central axis and pins being adapted for rotation inside the chamber;

a plurality of channels disposed in an inner wall surface of the cylindrical enclosure having a predetermined width, a predetermined depth and a predetermined clearance from the pins; and a plurality of blocks adapted for movement inside the treatment chamber, said movement of said blocks being actuated by collision with the pins, said blocks having a diameter in a range between about 0.3 inches to about 0.5 inches and weighing between about 1 gram and about 2 grams;

feeding the biomass materials into the feed zone of a treatment apparatus and moving said biomass materials from the feed zone toward the exit zone;

macerating the biomass materials; and collecting the biomass at the exit zone of said treatment apparatus.

2. The process of claim 1, wherein the clearance between the channels and an upper portion of the pins ranges from about 0.1 inches to about 0.15 inches.

3. The process of claim 1, wherein the depth and the width of said groves range from about 0.2 inches to about 0.5 inches.

4. The process of claim 1, wherein between about 0.5 and 4 blocks per gram of biomass particles are placed inside the treatment chamber.

5. The process of claim 1, further comprising intermixing aluminum silicate with the biomass at a dry weight ratio of between about 0.25 to about 1.0 of aluminum silicate to a weight of biomass prior to treatment.

6. The process of claim 5, further comprising injecting urea gas into the treatment chamber at a pressure of between about 0.0 KPa and about 2.0 KPa and a temperature of between about 40° C. and about 60° C.

7. The process of claim 5, further comprising intermixing dry urea in a granular form with the aluminum silicate at a ratio of between about 1% to about 2% by weight to dry biomass.

8. The process of claim 1, wherein macerating the biomass particles is actuated by rotating the shaft at a speed of between 200 and 2000 revolutions per minute.

9. The process of claim 1, further comprising pretreating the biomass materials with an acid solution at an application rate ranging from about 0.0001% to about 0.1% by weight of the oven dry biomass, said acid being selected from the group consisting of sulfuric acid, phosphoric acid, hydrochloric acid and nitric acid.

10. The process of claim 1, further comprising pretreating the biomass materials with an alkaline solution at an application rate ranging from about 0.01% to about 0.1% by weight of the oven dry biomass, said alkaline being selected from the group consisting of sodium hydroxide, calcium oxide and potassium hydroxide.

11. The process of claim 1 further comprising intermixing a particulate macerating aid with the biomass, said macerating aid being selected from the group consisting of zirconium dioxide ($ZrO_2$), calcium magnesium carbonate ($CaMg(CO_3)_2$), silica sand and combinations thereof, said macerating aids being intermixed at a ratio range of between about 0.25 dry grams to about 0.75 dry grams per gram of biomass.

* * * * *